US007815488B2

(12) United States Patent
Gransberry

(10) Patent No.: US 7,815,488 B2
(45) **Date of Patent: *Oct. 19, 2010**

(54) BRASSIERE CUP AND BRASSIERE MADE THEREFROM

(75) Inventor: Leslie A. Gransberry, Westport, CT (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 359 days.

This patent is subject to a terminal disclaimer.

(21) Appl. No.: 12/024,579

(22) Filed: Feb. 1, 2008

(65) Prior Publication Data

US 2009/0130953 A1 May 21, 2009

Related U.S. Application Data

(63) Continuation-in-part of application No. 11/725,068, filed on Mar. 16, 2007, now Pat. No. 7,727,048.

(51) Int. Cl.
*A41C 3/00* (2006.01)

(52) U.S. Cl. ..... 450/39; 450/37; 450/54

(58) Field of Classification Search ..... 450/37–39, 450/54–58, 36; 2/267, 268; 604/385.07, 604/74; 623/7, 8

See application file for complete search history.

(56) References Cited

U.S. PATENT DOCUMENTS

| | | | | |
|---|---|---|---|---|
| 3,021,844 | A | 2/1962 | Flagg et al. | |
| 3,021,845 | A | 2/1962 | Smith | |
| 3,101,717 | A | 8/1963 | Korman | |
| 3,187,753 | A | 6/1965 | Hershon | |
| 4,333,471 | A | 6/1982 | Nakai | |
| 4,372,321 | A | 2/1983 | Robinson | |
| 4,481,951 | A | 11/1984 | Cole et al. | |
| 4,557,267 | A | 12/1985 | Cole | |
| 4,640,288 | A | 2/1987 | Hattori | |
| 4,674,131 | A | 6/1987 | Broel | |
| 5,683,286 | A | 11/1997 | Kielland | |
| 6,083,080 | A | 7/2000 | Lawson et al. | |
| 6,213,841 | B1 | 4/2001 | Kuo | |
| 6,283,820 | B1 | 9/2001 | Huang | |
| 6,306,006 | B1 * | 10/2001 | Cheng | 450/57 |
| 6,350,175 | B2 | 2/2002 | Johnson et al. | |
| 6,398,620 | B1 | 6/2002 | Huang | |
| 6,406,352 | B1 | 6/2002 | Cheng | |
| 6,743,073 | B1 | 6/2004 | Tsai et al. | |

(Continued)

FOREIGN PATENT DOCUMENTS

| | | |
|---|---|---|
| FR | 990244 | 9/1951 |

(Continued)

*Primary Examiner*—Gloria Hale
(74) *Attorney, Agent, or Firm*—Womble Carlyle Sandridge & Rice, PLLC

(57) ABSTRACT

A brassiere cup, and brassiere formed therefrom, is provided, having an outer layer, an inner layer, a moldable foam layer positioned between the outer layer and the inner layer, and a concealing layer positioned between the inner layer and the moldable foam layer. The outer layer, inner layer, moldable foam layer, and concealing layer are molded to form a cup having an apex, with the concealing layer disposed over the apex. When molded, a raised embossed area is formed on the inner surface of the inner layer over the concealing layer.

17 Claims, 7 Drawing Sheets

U.S. PATENT DOCUMENTS

| | | | | |
|---|---|---|---|---|
| 6,857,935 | B1 | 2/2005 | Dohan | |
| 6,881,123 | B1 | 4/2005 | Klakauskas | |
| 6,997,775 | B2 * | 2/2006 | Jagaric et al. | 450/57 |
| 7,081,034 | B1 | 7/2006 | Zoellner | |
| 7,198,540 | B2 | 4/2007 | Lau | |
| 7,214,121 | B1 | 5/2007 | Huang | |
| 2005/0037689 | A1 | 2/2005 | Gorski et al. | |
| 2005/0085161 | A1 | 4/2005 | Klakauskas | |
| 2006/0057938 | A1 | 3/2006 | Huang | |
| 2006/0089084 | A1 | 4/2006 | Dohan | |

FOREIGN PATENT DOCUMENTS

| | | | |
|---|---|---|---|
| FR | 2870681 | A | 12/2005 |
| WO | WO 03/105616 | | 12/2003 |
| WO | 2004073433 | A2 | 9/2004 |
| WO | 2005094426 | A2 | 10/2005 |

* cited by examiner

BRASSIERE CUP AND BRASSIERE MADE THEREFROM

This application is a Continuation-in-Part of application Ser. No. 11/725,068, filed Mar. 16, 2007, now U.S. Pat. No. 7,727,048.

FIELD OF THE INVENTION

This invention relates to a brassiere cup that offers modesty to the wearer, and a brassiere using such a cup. More, particularly, the invention relates to a brassiere cup that has a concealing layer, or cover, located at the apex of the brassiere cup to offer modesty to the wearer, and the brassiere made using such a cup.

BACKGROUND

Conventional brassieres for everyday wear should offer comfort as well as coverage to the wearer. Consumers want to feel comfortable when wearing lightweight clothes, yet confident that their undergarments, specifically brassieres, are providing adequate coverage. Brassieres that are too sheer and thin are not likely to provide the wearer with the desired level of modesty and discretion. At the other extreme, foam brassieres that are thick and offer modesty are often excessively padded, thus uncomfortable and hide the wearer's natural shaping.

Accordingly, there is a need for a padded cup for a brassiere, and a brassiere, that offers modesty with lightweight padding and optimal comfort.

SUMMARY OF THE INVENTION

The present invention provides for a padded cup for a brassiere that offers modesty.

The present invention also provides for a padded cup for a brassiere that incorporates a region of additional coverage at the apex of the cup for modesty.

The present invention further provides for a brassiere that offers modesty to the wearer with lightweight padding.

The present invention yet further provides for a padded cup for a brassiere that incorporates a fabric region that covers the apex of the cup.

The present invention yet still further provides for a padded cup for a brassiere that incorporates a decoratively shaped fabric region that covers the apex of the cup.

The present invention provides for a padded cup for a brassiere that incorporates a centrally located decoratively shaped fabric region to cover a protuberance or feature of the breast, such as the nipple, and offers optimal modesty and a brassiere that incorporates such a fabric region.

The present invention provides for a brassiere that incorporates a pair of padded cups, each of the cups having a fabric region that covers the apex of a respective cup of the brassiere, the fabric region not being visible from the outside of the facing surface of the brassiere, or beneath clothing.

A padded cup for a brassiere having a foam layer, an inner layer and a concealing layer positioned between the foam layer and the inner layer is provided. The concealing layer is positioned between the foam layer and the inner layer to provide enhanced coverage to the brassiere.

A brassiere having a pair of breast-receiving cups is provided. Each of the pair of breast-receiving cups has a pad having a foam layer, an inner layer, and a concealing layer positioned between the foam layer and the inner layer. The concealing layer is positioned between the foam layer and the inner layer to provide enhanced coverage to the brassiere.

BRIEF DESCRIPTION OF THE DRAWINGS

These and further objects, advantages and features of the invention will be understood by reference to the following specification in conjunction with the accompanying drawings, in which like reference characters denote like elements of structure and.

DETAILED DESCRIPTION

Figure 1:
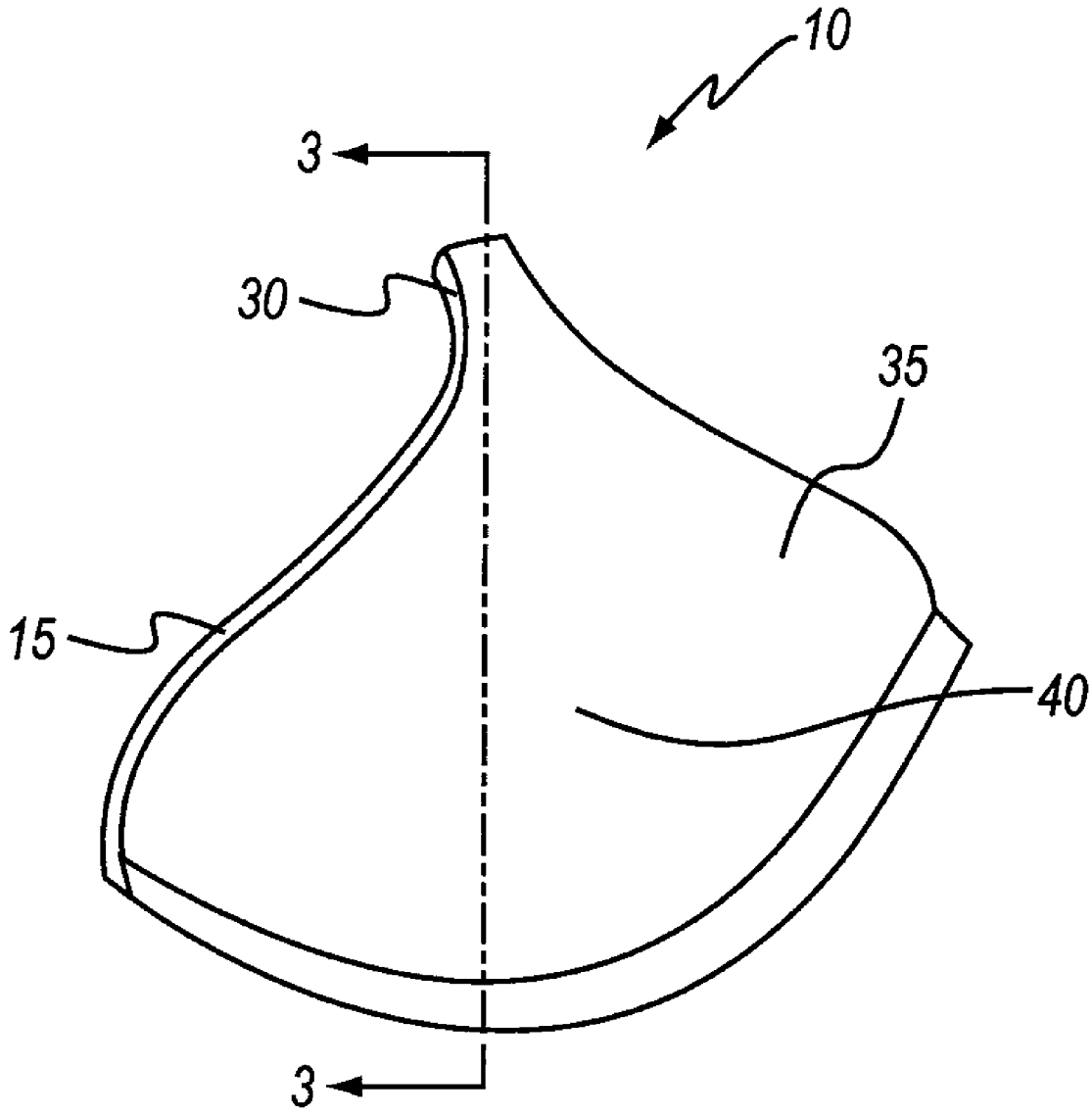
FIG. 1 illustrates a perspective view of the padded cup of the present invention.

In reference to the drawings and, in particular, to FIG. 1, there is illustrated a brassiere cup, generally represented by reference numeral 10. The brassiere cup 10 is a molded multi-layer construction. Cup 10 has an inner layer 15 at a concave surface or inner surface of cup 10. Cup 10 has an outer layer 35 at a convex layer or surface of cup 10. Between inner layer 15 and outer layer 35 is a foam layer 30. Foam layer 30 has a degree of thickness to provide a light degree of coverage and loft when placed in a brassiere. Cup 10 has an apex 40 centrally located at mid portion of the cup 10. While cup 10 has a generally uniform thickness, regions of differing thicknesses could also be used in the cup 10 to offer different effects to the wearer.

Figure 2:
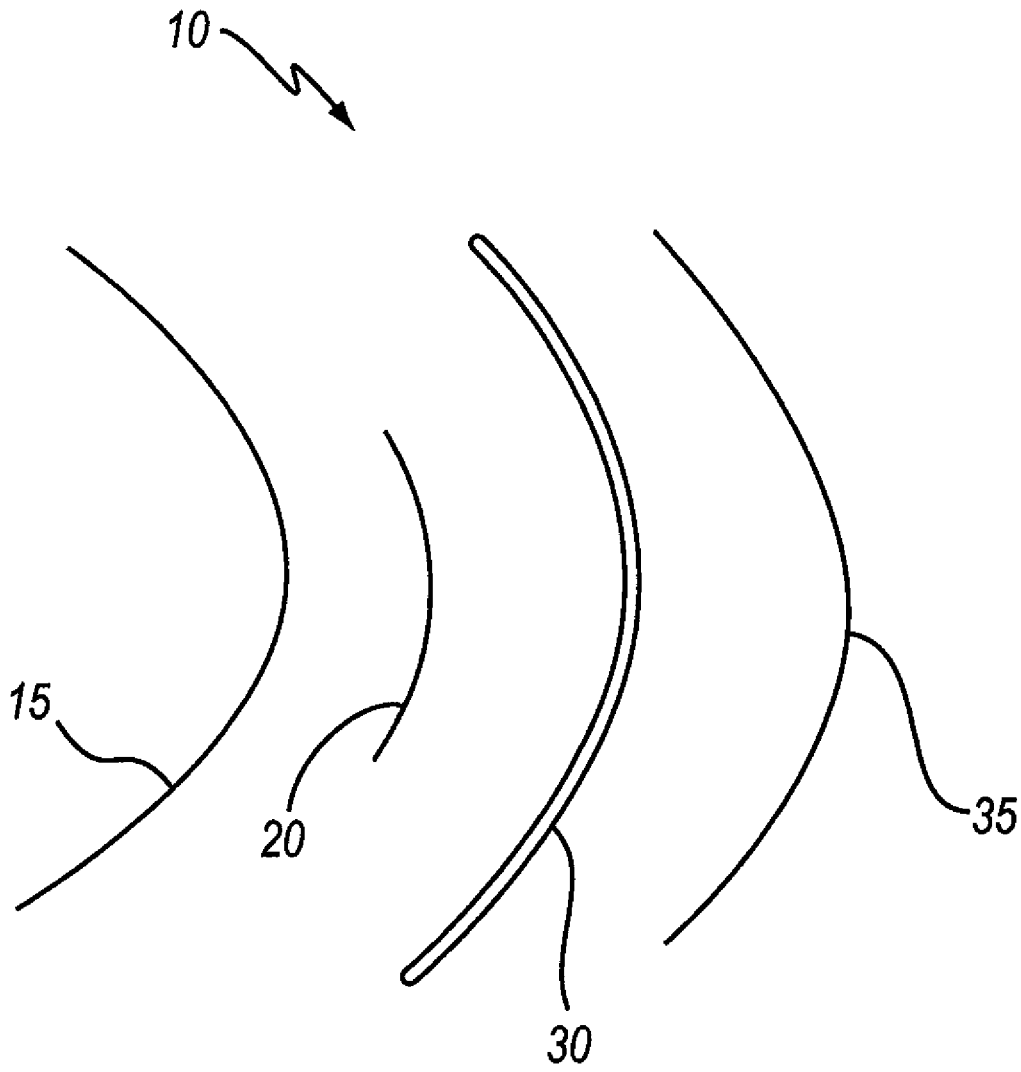
FIG. 2 illustrates an exploded view of the padded cup of FIG. 1 of the present invention.

Referring to FIG. 2, cup 10 is shown in an exploded view. Between inner layer 15 and foam layer 30 is a fourth layer, or concealing layer 20. Layer 20 has a smaller surface than layers 15, 30 or 35. Layer 20 is centrally located over apex 40 of the cup 10. When the cup 10 is fitted within a brassiere, layer 20 is coincident with apex 40 of the brassiere to offer complete coverage and modesty to the wearer. While layer 20 is shown coincident with the apex 40, on a different style of brassiere, for example, balconette or demi-cup brassieres, layer 20 would be coincident with the desired anatomical feature to provide optimal modesty.

Figure 3:
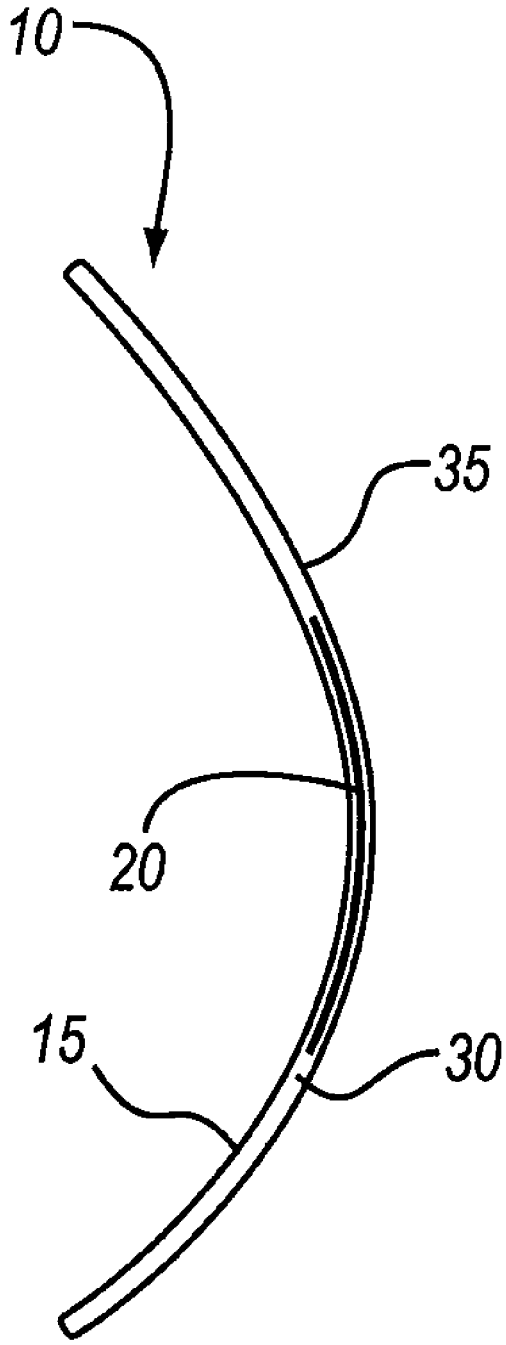
FIG. 3 illustrates a cross-sectional view of the padded cup of the present invention, taken along line 3-3.

Cup 10 provides a thin low to medium coverage pad, as shown in FIG. 3. Typically such cups, when formed in a brassiere, will not provide substantial modesty to the wearer when thin or revealing outer clothes are worn. However, concealing layer 20, of the present invention is centrally located to ensure that despite the minimal thickness of the cup 10, that adequate coverage is provided. Were layer 20 not present between layers 15 and 30, the wearer's modesty would not be preserved and undesired exposure of the nipple would be visible through the outer clothing. When cup 10 is incorporated into a brassiere of the present invention, a minimally padded brassiere is formed that provides full modesty and coverage to the wearer. Such a brassiere incorporating cup 10 eliminates the need to wear a heavily padded brassiere to achieve full modesty.

Figure 5:
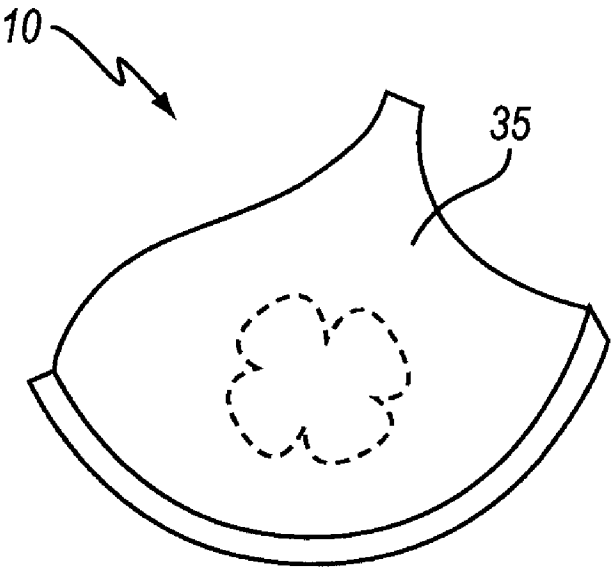
FIG. 5 illustrates a front view of the padded cup of the present invention showing the hidden lines of the concealing layer.
Figure 4:
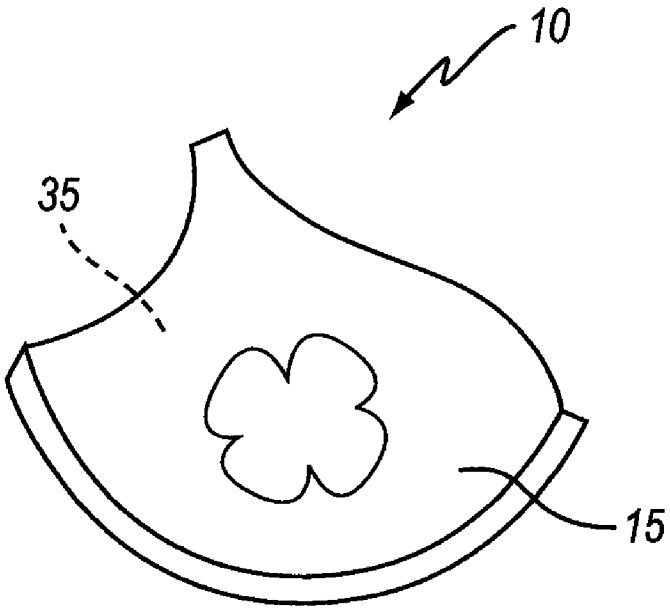
FIG. 4 illustrates a rear view of the padded cup of the present invention showing the outline of the inner surface of the cup.

Referring to FIGS. 2, 4 and 5, cover 20 is located between layer 15 and foam layer 30, to ensure invisibility beneath outer clothing. Foam layer 30 acts as a buffer to prevent any possible relief or visibility of the concealing layer beneath clothing. Were layer 20 between foam layer 30 and outer layer 35, then layer 20 would possibly be visible through outer layer 35 and beneath clothing. While layer 20 is invisible from outer layer 35, it is visible through concave layer 15 in relief.

Layer 20 is preferably a layer of material, such as, nylon, although other materials such as polyester or cotton that have a smooth surface when molded/laminated between inner layer 15 and foam layer 30, could also be used. Similarly, a laminated package of a combination of materials that have a smooth surface when molded, could also be used. Layer 20 is preferably made of any material or combination of materials that easily drapes or conforms during the lamination and molding processes. Layer 15 made from a material such as polyester, nylon, cotton blend or a rayon blend, or any other material that is easily molded. Layer 35 is made from the same or similar material as layer 15 that is easily molded. Layer 30 is a layer of foam, preferably polyurethane foam, or any other similar material that is easily molded and laminated and capable of withstanding heat and numerous washings.

Referring to FIG. 4, the concave or inner surface of cup 10 is shown. Layer 20 is shown and shaped as a flower. While layer 20 has a decorative shape, the shape is also functional. The flower shape permits layer 20 to more easily conform to the shape of the apex compared to other shapes. For example a purely circular concealing layer, if made from a stiff material, would tend to have puckers or ripples at its edges when it is molded at the apex of the pad. A circular shape of a supple material, however, would provide proper draping. Other shapes that would also be functional as well as decorative are a clover, a star or a sunburst. As shown in FIG. 5, the outer surface of cup 10 does not show the outline of concealing layer 20.

Figure 6:
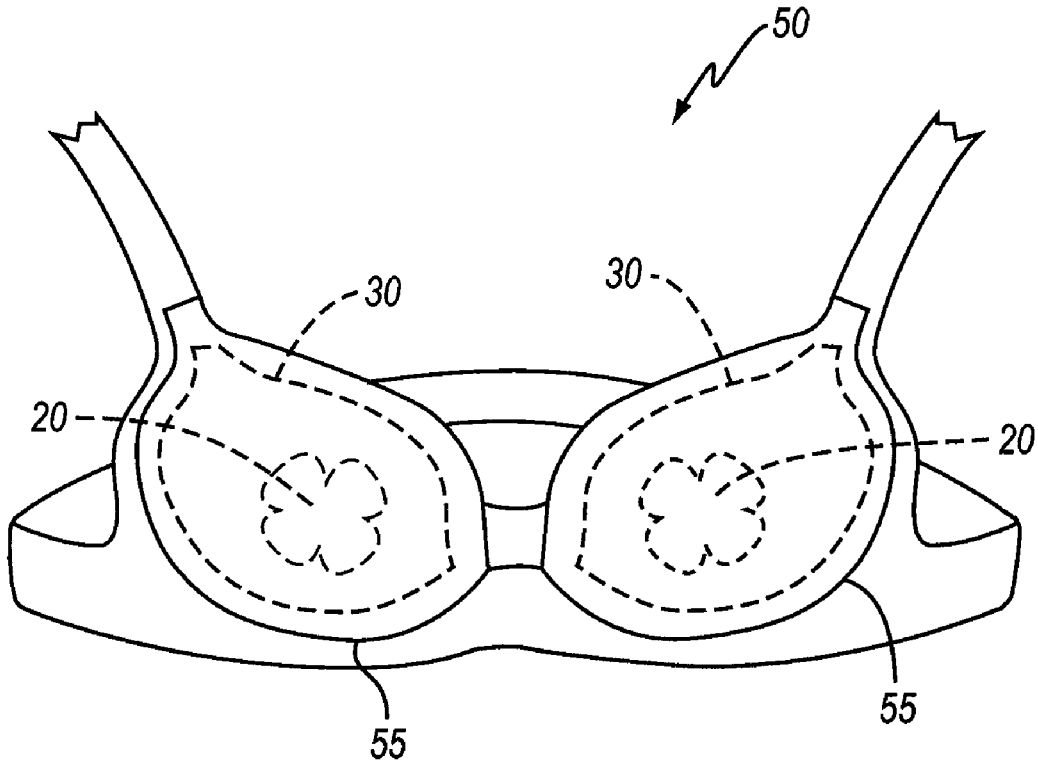
FIG. 6 illustrates a brassiere incorporating the padded cup of the present invention.

FIG. 6 shows a brassiere 50 that incorporates the cup 10 at 55. Brassiere 50 is shown as a softcup brassiere, however, cup 10 of the present invention can be incorporated into an underwire, a strapless brassiere, a sports brassiere, or a demi-cup brassiere for example. Brassiere 50, when worn, offers the wearer the convenience and comfort of a lightweight brassiere and the confidence and modesty of a heavily padded brassiere. Concealing layer generally has a smaller surface area than inner liner layer 15, foam layer 30 and outer layer 35. By having a smaller surface area than the other layers of cup 10, brassiere 50 offers a low padded brassiere that provides full modesty and coverage.

Figure 7:
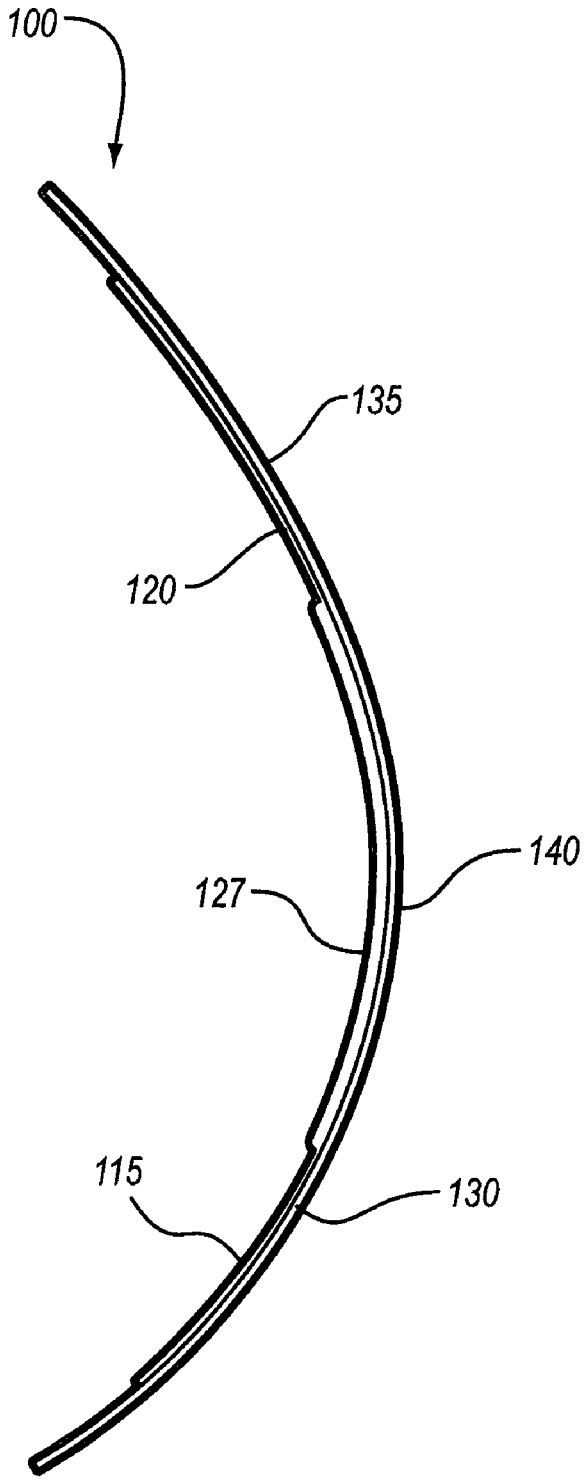
FIG. 7 illustrates an alternative embodiment of the padded cup of the present invention.

Turning now to FIG. 7, an alternative embodiment of the brassiere cup 100 is shown. This embodiment also comprises a multi-layer construction including an inner layer 115 at the concave surface, or inner surface, a foam pad 130, and an outer layer 135 at a convex surface, or outer surface, of the cup 100 construction. Inner layer 115, outer layer 135, and foam layer 130 are all formed of materials similar to those materials described hereinabove for the embodiment illustrated in FIGS. 1 through 6.

The foam layer 130 is situated between the inner layer 1 15 and the outer layer 135, again having a degree of thickness sufficient to provide a light degree of coverage and loft when formed in a brassiere. As shown in FIG. 7, a concealing layer 120 is approximately centrally located over the apex 140 of the cup 100.

Figure 9:
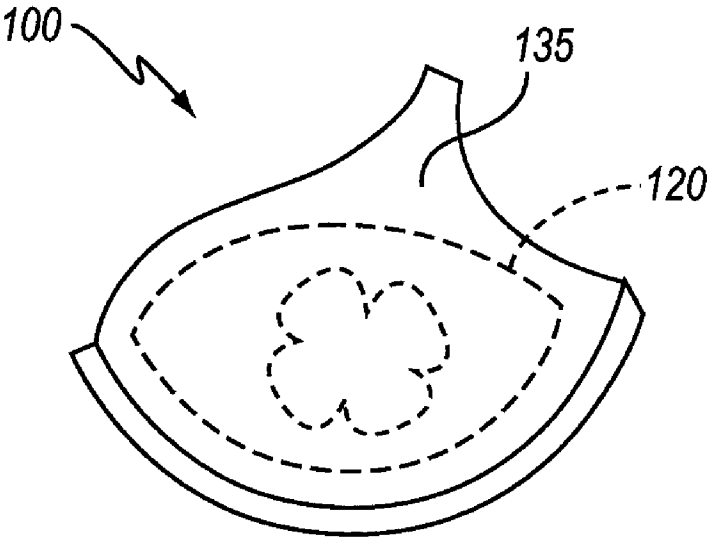
FIG. 9 illustrates a front view of the padded cup of FIG. 7, showing the hidden lines of the concealing layer.
Figure 8:
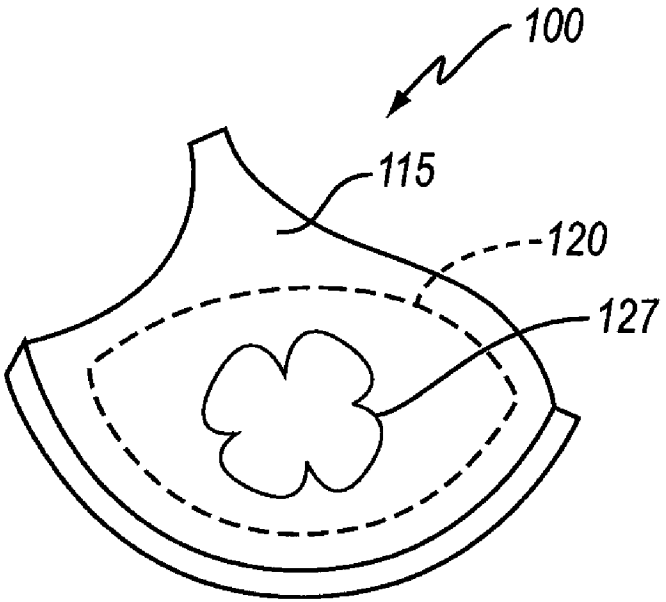
FIG. 8 illustrates a rear view of the padded cup of FIG. 7, showing the embossed relief on the inner surface of the cup.

As shown in FIGS. 7 through 9, a decorative shape, such as a flower, is formed during the molding process of the brassiere cup 100. Rather than die-cutting a concealing layer 120 of a particular decorative shape in advance of positioning the concealing layer 120 between the foam layer 130 and the inner layer 115, the multi-layer cup 100 is initially formed with a shaped, but non-decorative, concealing layer 120. It has been found that beginning the multi-layer construction with a non-decorative concealing layer is less costly that a die-cut, or pre-cut, concealing layer both in terms of the cost of the concealing layer itself, and in the cost of the labor required to position properly the smaller die-cut concealing layer between the foam layer 130 and the inner layer 115. As best seen in FIGS. 8 and 9, the concealing layer 120 of this embodiment does not initially have a decorative shape; rather, the concealing layer 120 is an oval-shaped layer that is suitably dimensioned and suitable for laminating and molding. Other shapes suitable for molding, without puckering or wrinkling when molded, may be used.

During the molding process, a decorative design, such as a raised flower 127, may be formed by the molding apparatus. Specifically, the female portion of the mold has a smooth surface, as is conventional, such that the outer shape and appearance of the foam pad and brassiere cup are smooth, shape enhancing, and concealing. The male mold portion, however, has a decoratively-shaped recesss of a selected design, such as the flower shown in FIG. 8, formed therein. Thus, during the molding process, as the male portion of the mold compresses the multiple layers to form the breast cup, the layers forming the cup are not compressed within the recessed area of the mold to the same extent that the surrounding areas of the cup 100 are compressed. This results in a raised, or embossed, decorative area 127 on the inner surface of the inside layer 115 of the brassiere cup 100 and a smooth outer surface 135.

As shown in FIG. 9, neither the embossed decorative area 127 nor the outline of concealing layer 120 are visible on the outside layer 135 of the cup 100, or brassiere. Not only does this manner of molding produce an aesthetically pleasing design on the inside surface of the brassiere cup, but it also results in a concealing layer 120 at the apex 140 that has a greater thickness, and thus greater concealment at the apex 140. As will be appreciated, the unembossed area of the concealing cover 120 also provides concealment about the apex 140, although without the same decorative effect as the decorative area 127. Further, the decorative effect of the decorative area 127 is aesthetically pleasing to the wearer.

While the present disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the disclosure.

I claim:

1. A brassiere cup, comprising:

(a) an outer layer having a peripheral edge;

(b) an inner layer for wear adjacent a wearer's breast and having a peripheral edge;

(c) a moldable foam layer positioned between the outer layer and the inner layer and having a peripheral edge;

(d) a concealing layer having a peripheral edge and positioned between the inner layer and the moldable foam layer, the peripheral edges of the outer layer, the inner layer, and the moldable foam layer extending outwardly beyond the peripheral edge of the concealing layer;

(e) the outer layer, inner layer, moldable foam layer, and concealing layer are molded to form a cup having an apex, the concealing layer disposed over the apex; and (f) when molded, a singular raised embossed area is formed on the inner layer over the concealing layer, the raised embossed area projecting inwardly toward the wearer's breast.

2. The brassiere cup of claim 1, wherein the outer layer is formed from a material selected from the group consisting of polyester, nylon, cotton, rayon, and blends thereof.

3. The brassiere cup of claim 1, wherein the inner layer is formed from a material selected from the group consisting of polyester, nylon, cotton, rayon, and blends thereof.

4. The brassiere cup of claim 1, wherein the moldable foam layer is polyurethane foam.

5. The brassiere cup of claim 1 wherein the concealing layer is formed from a moldable material.

6. The brassiere cup of claim 5, wherein the concealing layer is formed from a material selected from the group consisting of nylon, polyester, cotton, and blends thereof.

7. The brassiere cup of claim 1, wherein the raised embossed area is a decorative shape having a singular perimeter.

8. The brassiere cup of claim 7, wherein the decorative shape is selected from the group consisting of a clover, a flower, a star, and a sunburst.

9. A brassiere comprising:

(a) a pair of breast cups, wherein each of the breast cups comprises:

(i) an outer layer having a peripheral edge;

(ii) an inner layer for wear adjacent a wearer's breast and having a peripheral edge;

(iii) a moldable foam layer positioned between the outer layer and the inner layer and having a peripheral edge;

(iv) a concealing layer having a peripheral edge and positioned between the inner layer and the moldable foam layer, the peripheral edges of the outer layer, the inner layer, and the moldable foam layer extending outwardly beyond the peripheral edge of the concealing layer;

(v) the outer layer, inner layer, moldable foam layer, and concealing layer are molded to form a cup having an apex, the concealing layer disposed over the apex;

(vi) when molded, a singular raised embossed area is formed on the inner layer over the concealing layer, the raised embossed area projecting inwardly toward the wearer's breast;

(b) a pair of backstraps, one of the pair of backstraps connected to one of the pair of breast cups, and the other of the pair of backstraps connected to the other of the pair of breast cups.

10. The brassiere of claim 9, wherein the outer layer is formed from a material selected from the group consisting of polyester, nylon, cotton, rayon, and blends thereof.

11. The brassiere of claim 9, wherein the inner layer is formed from a material selected from the group consisting of polyester, nylon, cotton, rayon, and blends thereof.

12. The brassiere of claim 9, wherein the moldable foam layer is polyurethane foam.

13. The brassiere of claim 9, wherein the concealing layer is formed from a moldable material.

14. The brassiere of claim 13, wherein the concealing layer is formed from a material selected from the group consisting of nylon, polyester, cotton, and blends thereof.

15. The brassiere of claim 9, wherein the raised embossed area is a decorative shape having a singular perimeter.

16. The brassiere of claim 15, wherein the decorative shape is selected from the group consisting of a clover, a flower, a star, and a sunburst.

17. The brassiere of claim 9, further comprising a pair of shoulder straps, one of the pair of shoulder straps connecting one of the breast cups to one of the backstraps, and the other of the pair of shoulder straps connecting the other of the breast cups to the other of the backstraps.

* * * * *